US010947646B2

(12) United States Patent
Chiang

(10) Patent No.: US 10,947,646 B2
(45) Date of Patent: Mar. 16, 2021

(54) ELASTIC BAND

(71) Applicant: Mi Shen Chiang, Kaohsiung (TW)

(72) Inventor: Mi Shen Chiang, Kaohsiung (TW)

( * ) Notice: Subject to any disclaimer, the term of this patent is extended or adjusted under 35 U.S.C. 154(b) by 150 days.

(21) Appl. No.: 16/262,916

(22) Filed: Jan. 31, 2019

(65) Prior Publication Data

US 2020/0248344 A1 Aug. 6, 2020

(51) Int. Cl.
*D03D 3/00* (2006.01)
*A63B 21/00* (2006.01)
*A63B 21/055* (2006.01)

(52) U.S. Cl.
CPC ..... *D03D 3/005* (2013.01); *A63B 21/00043* (2013.01); *A63B 21/0555* (2013.01); *A63B 2209/023* (2013.01); *D10B 2401/061* (2013.01); *D10B 2507/00* (2013.01)

(58) Field of Classification Search
CPC ..... A63B 21/0555
USPC ..... 482/121–124; 428/121
See application file for complete search history.

(56) References Cited

U.S. PATENT DOCUMENTS 5,205,803 A * 4/1993 Zemitis ..... A63B 21/0552 482/121
5,963,988 A * 10/1999 Jackson, Jr. ..... A41F 9/025 139/422
7,201,024 B2 * 4/2007 Hirayama ..... D04B 21/12 66/192
7,305,996 B2 * 12/2007 Kraft ..... A45D 8/34 132/273
7,794,374 B1 * 9/2010 Park ..... A63B 21/0552 482/122
8,915,101 B2 * 12/2014 Koizumi ..... D04B 27/10 66/193
9,630,081 B2 * 4/2017 Gillespie ..... A63B 21/0555
2007/0232468 A1 * 10/2007 Levy ..... A63B 21/028 482/121
2008/0163408 A1 * 7/2008 Tseng ..... D04B 1/18 2/336
2009/0176634 A1 * 7/2009 Wu ..... A63B 21/0552 482/122
2010/0216613 A1 * 8/2010 Pacini ..... A63B 21/0552 482/122

(Continued)

FOREIGN PATENT DOCUMENTS

WO WO-2014075313 A1 * 5/2014 ..... A45C 3/001

OTHER PUBLICATIONS

English Translation of WO 2014/07513, "Elastic Webbing and Weaving Method"; ip.com, published May 22, 2014. (Year: 2014).*

*Primary Examiner* — Nina Bhat

(57) ABSTRACT

An elastic band contains: multiple warps, multiple latex yarns, and plural latex threads which are interweaved so as to produce the elastic band. The multiple warps include a plurality of cloth layers formed on side surfaces and bottoms of the multiple warps respectively, and the multiple warps include multiple elastic layers arranged among the plurality of cloth layers individually. The multiple elastic layers are interweaved by the multiple warps, the multiple latex yarns, and plural latex threads. A sewing machine includes multiple frames and multiple steel buckles so that the multiple warps are inserted through multiple frames repeatedly, and the multiple warps, the multiple latex yarns and the plural latex threads are inserted through the multiple steel buckles repeatedly so as to produce the elastic band.

5 Claims, 13 Drawing Sheets

(56) References Cited

U.S. PATENT DOCUMENTS

| | | | | |
|---|---|---|---|---|
| 2013/0012368 | A1* | 1/2013 | Verruto | A63B 21/0004 482/124 |
| 2014/0106120 | A1* | 4/2014 | Slavicek | B32B 25/16 428/138 |
| 2014/0274601 | A1* | 9/2014 | Crowell | A63B 21/028 482/121 |
| 2015/0251040 | A1* | 9/2015 | Pinder | A63B 21/4015 482/124 |
| 2015/0367159 | A1* | 12/2015 | Harris | A63B 21/00069 482/122 |
| 2016/0038781 | A1* | 2/2016 | Christie | A63B 21/0552 482/121 |
| 2016/0074692 | A1* | 3/2016 | Vial | A63B 21/0557 482/122 |
| 2016/0129294 | A1* | 5/2016 | Gillespie | A63B 21/0555 482/124 |
| 2016/0199682 | A1* | 7/2016 | Borak | A63B 21/0555 482/126 |

* cited by examiner

ELASTIC BAND

FIELD OF THE INVENTION

The present invention relates to an elastic band which is applied to exercise.

BACKGROUND OF THE INVENTION

A conventional elastic band is employed to exercise by a user, but it is easy to be broken because of insufficient reinforcement.

Furthermore, the conventional elastic band cannot be stretched and retracted randomly, and it is easy to cause elasticity fatigue after a period of using time.

The present invention has arisen to mitigate and/or obviate the afore-described disadvantages.

SUMMARY OF THE INVENTION

The primary aspect of the present invention is to provide an elastic band which is applied to exercise.

To obtain the above-mentioned aspect, an elastic band provided by the present invention contains: multiple warps, multiple latex yarns, and plural latex threads which are interweaved so as to produce the elastic band.

The multiple warps include a plurality of cloth layers formed on side surfaces and bottoms of the multiple warps respectively, and the multiple warps include multiple elastic layers arranged among the plurality of cloth layers individually.

The multiple elastic layers are interweaved by the multiple warps, the multiple latex yarns, and plural latex threads.

In various embodiments, the multiple latex yarns and the plural latex threads are replaced by rubber threads or the multiple latex yarns and the plural latex threads are replaced by thermoplastic rubber (TPR).

A sewing machine includes multiple frames and multiple steel buckles so that the multiple warps are inserted through multiple frames repeatedly, and the multiple warps, the multiple latex yarns and the plural latex threads are inserted through the multiple steel buckles repeatedly so as to produce the elastic band.

Preferably, a number of the multiple fames is within 8 to 17.

Preferably, a number of multiple steel buckles is within 28 to 36.

Preferably, a number of the multiple fames is 14.

Preferably, a number of multiple steel buckles is 33.

Preferably, the fourteen frames are pulled by multiple flower chains based on eight high-and-low sequences so as to weave the plurality of cloth layers and the multiple elastic layers.

Preferably, a number of the multiple warps is 240, and a number of the plural latex threads is 151.

Preferably, a plurality of cloth layers are covered on the multiple elastic layers so as to be stretched and retraced with the multiple elastic layers, wherein a stretching ratio of the plurality of cloth layers and the multiple elastic layers is within 100% to 400%.

Preferably, a width of the elastic band is within 1 cm to 11 cm, a thickness of the elastic band is within 0.4 cm to 5 cm, and a length of the elastic band is within 50 cm to 500 cm.

Preferably, the multiple latex yarns and the plural latex threads are replaced by rubber thread.

Preferably, the multiple latex yarns and the plural latex threads are replaced by thermoplastic-rubber (TPR).

DETAILED DESCRIPTION OF THE FIRST EMBODIMENTS

Figure 1:
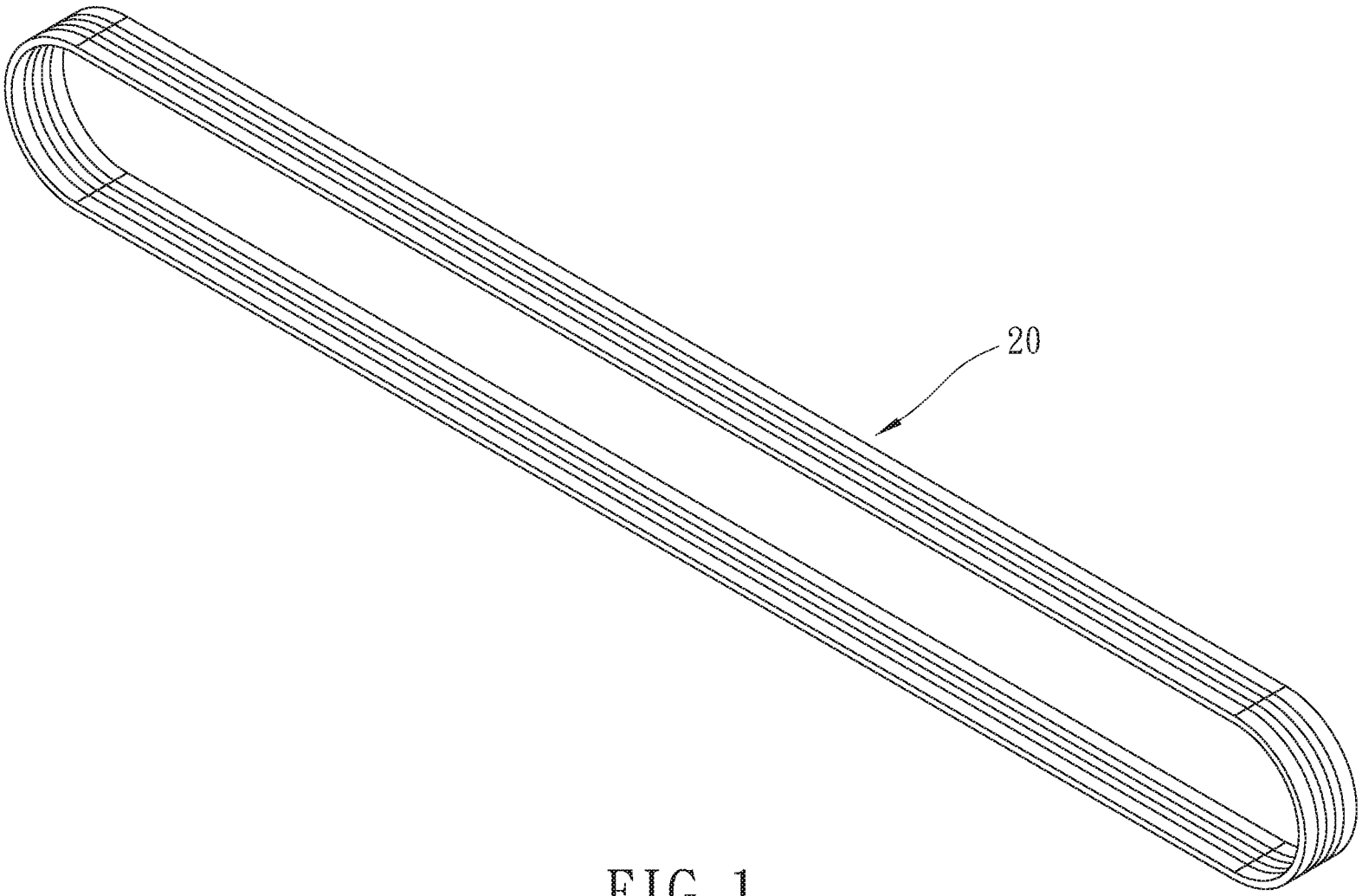
FIG. 1 is a perspective view showing the assembly of an elastic band according to a preferred embodiment of the present invention.
Figure 2:
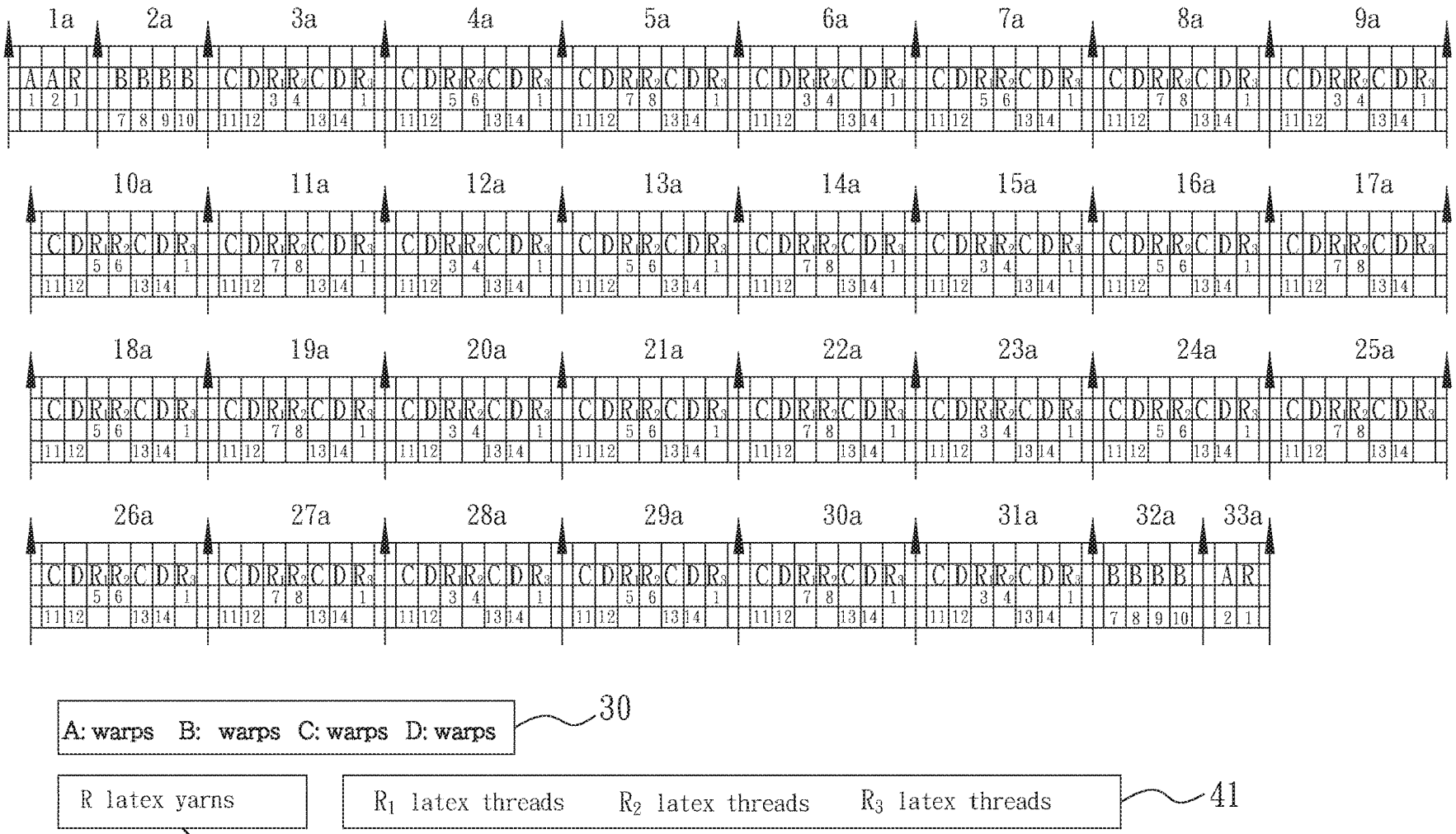
FIG. 2 is a schematic view showing the manufacture process of the elastic band according to the preferred embodiment of the present invention.
Figure 3:
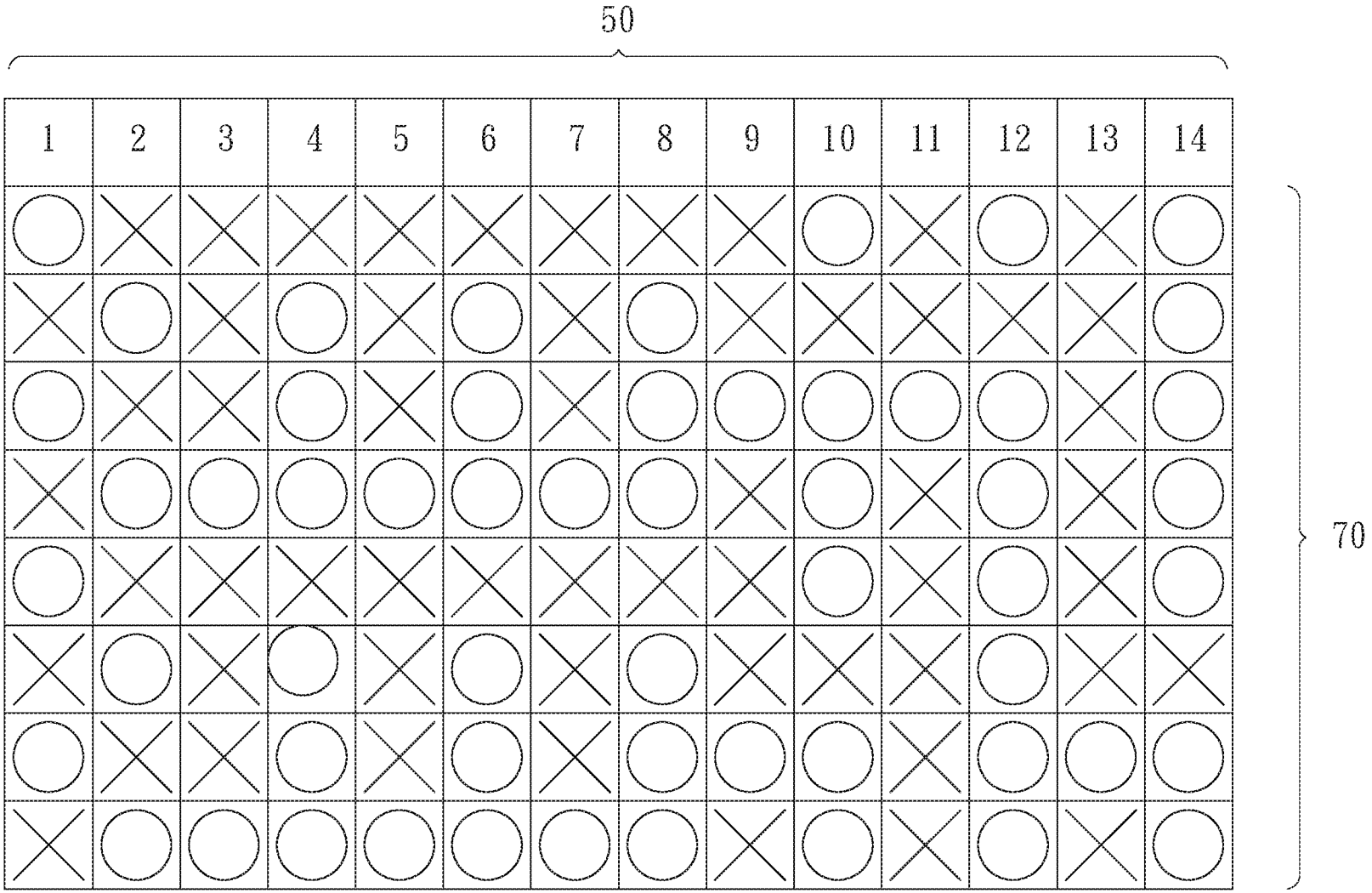
FIG. 3 is another schematic view showing the manufacture process of the elastic band according to the preferred embodiment of the present invention.

With reference to FIGS. 1-3, an elastic band 20 according to a preferred embodiment of the present invention comprises: multiple warps 30, multiple latex yarns 40, and plural latex threads 41 which are interweaved so as to produce the elastic band 20.

The multiple warps 30 include a plurality of cloth layers 31 formed on side surfaces and bottoms of the multiple warps 30 respectively, and the multiple warps 30 include multiple elastic layers 32 arranged among the plurality of cloth layers 31 individually. The multiple elastic layers 32 are interweaved by the multiple warps 30, the multiple latex yarns 40, and plural latex threads 41, wherein the multiple warps 30 are inserted through fourteen frames 50, wherein the multiple warps 30, the multiple latex yarns 40, and the plural latex threads 41 are inserted through thirty-three steel buckles 60 and the fourteen frames 50 repeatedly so as to produce the elastic band 20. The fourteen frames 50 are pulled by multiple flower chains based on eight high-and-low sequences 70 so as to weave the plurality of cloth layers 31 and the multiple elastic layers 32. A width of the elastic band 20 is within 1 cm to 11 cm, a thickness of the elastic band 20 is within 0.4 cm to 5 cm, and a length of the elastic band 20 is within 50 cm to 500 cm.

Referring to FIG. 2, a sewing machine includes the fourteen frames 50 and the thirty-three steel buckles 60 so that the multiple warps 30, the multiple latex yarns 40, and the plural latex threads 41 are inserted through thirty-three steel buckles 60 and the fourteen frames 50 repeatedly so as to produce the elastic band 20.

As shown in FIG. 1, the thirty-three steel buckles 60 are represented by 1*a* to 33*a*, the multiple warps 30 are denoted by A, B, C, and D. The multiple latex yarns 40 are indicated by R, and the plural latex threads 41 are represented by R1, R2, and R3. A number of first warps A is 3, a number of second warps B is 16 (2 in 1 inserting), a number of third warps C is 174 (3 in 1 inserting), and a number of fourth warps D is 174 (3 in 1 inserting). A number of the latex yarns R is 4 (one latex yarn R is arranged on a needle point, and the other latex yarns R is arranged on a selvage). A number of first latex threads R1 is 145 (5 in 1 inserting), a number of second latex threads R2 is 145 (5 in 1 inserting), a number of third latex threads R3 is 28 (inserting through a first frame 50), wherein a numerical reference 1 to 14 represent fourteen frames 50. Each of the multiple latex yarns 40 has a covering layer so as to enhance reinforcement of each latex yarn 40, wherein the covering layer of each latex yarn 40 is arranged on the needle point and the selvage.

As illustrated in FIG. 3, each of multiple circles denotes high, each of multiple X marks represents low, wherein the high and the low have eight high-and-low sequences 70. The fourteen frames 50 are pulled by the multiple flower chains based on the eight high-and-low sequences 70 so as to weave the plurality of cloth layers 31, and the multiple elastic layers 32 are weaved among the plurality of cloth layers 31, thus producing the elastic band 20.

In another embodiment, a number of the multiple fames 50 is within 8 to 17, and a number of multiple steel buckles 60 is within 28 to 36. A number of the multiple warps 30 is 240, a number of the multiple latex yarns 40 is 4, and a number of the plural latex threads 41 is 151. The plurality of cloth layers 31 are covered on the multiple elastic layers 32 so as to be stretched and retraced with the multiple elastic layers 32, wherein a stretching ratio of the plurality of cloth layers 31 and the multiple elastic layers 32 is within 100% to 400%. The multiple latex yarns 40 and the plural latex threads 41 are replaced by rubber thread or thermoplastic-rubber (TPR).

Figure 4:
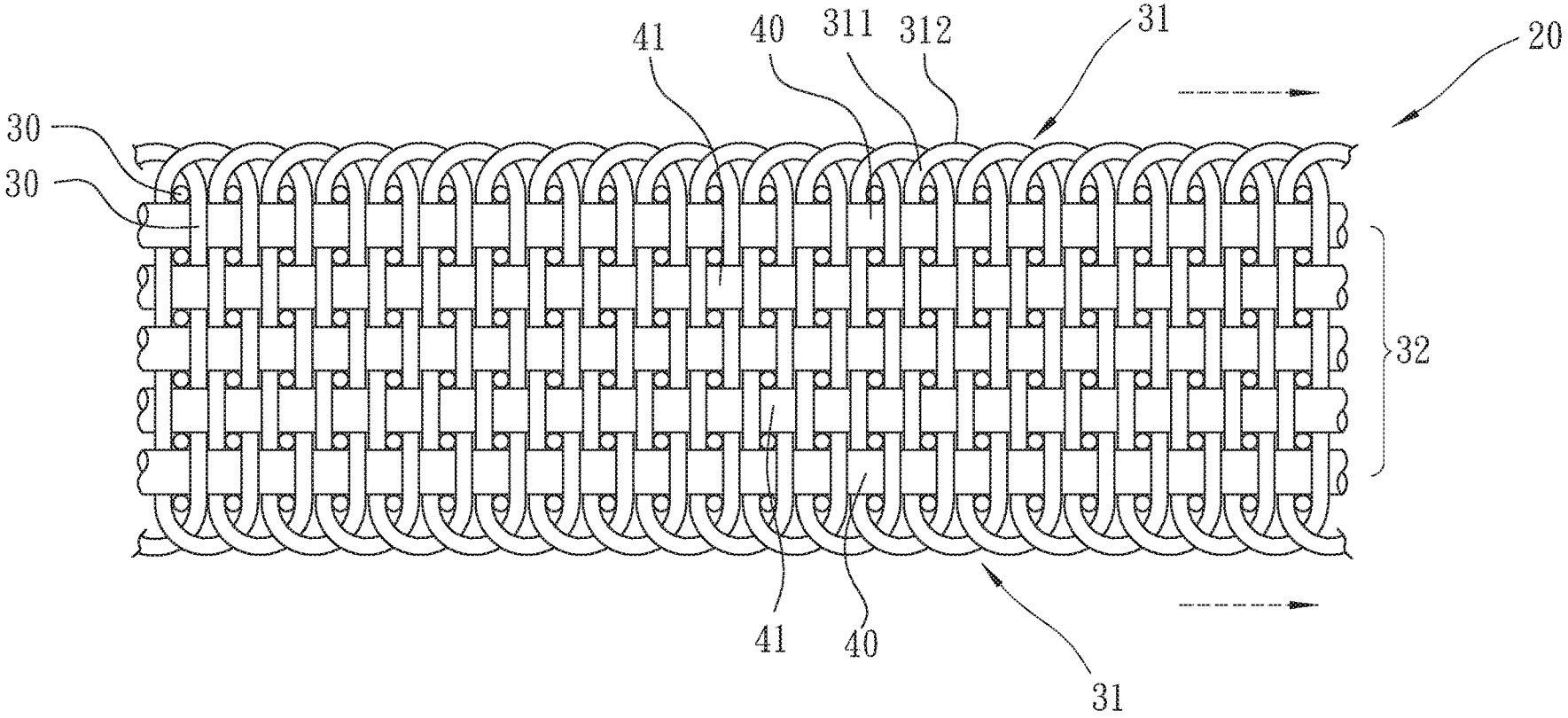
FIG. 4 is a side plan view showing multiple latex yarns, plural latex threads, and a plurality of cloth layers being not stretched according to the preferred embodiment of the present invention.
Figure 5:
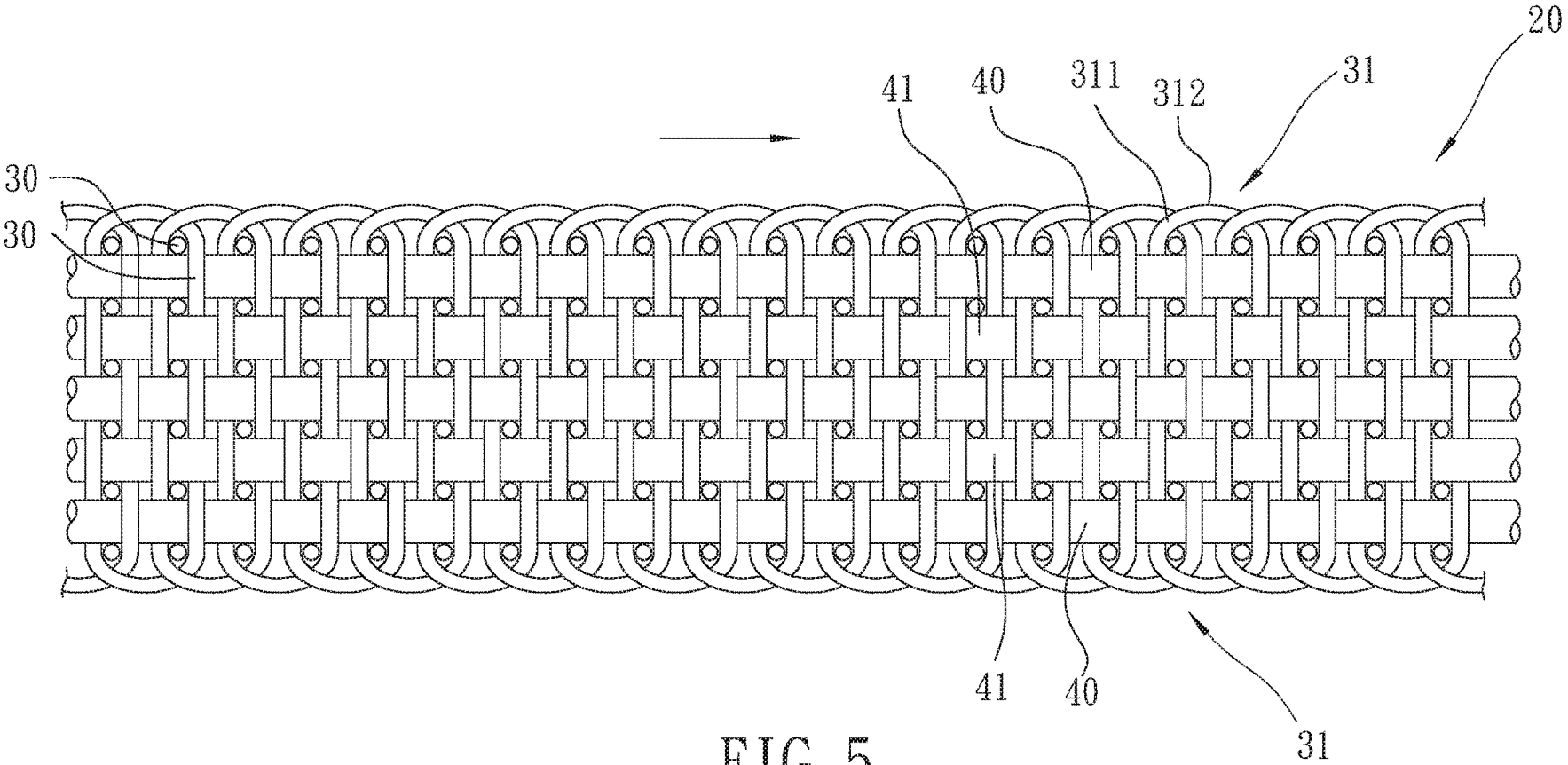
FIG. 5 is a side plan view showing a plurality of cloth layers having multiple patterns and plural arcuate portions respectively according to the preferred embodiment of the present invention.
Figure 6:
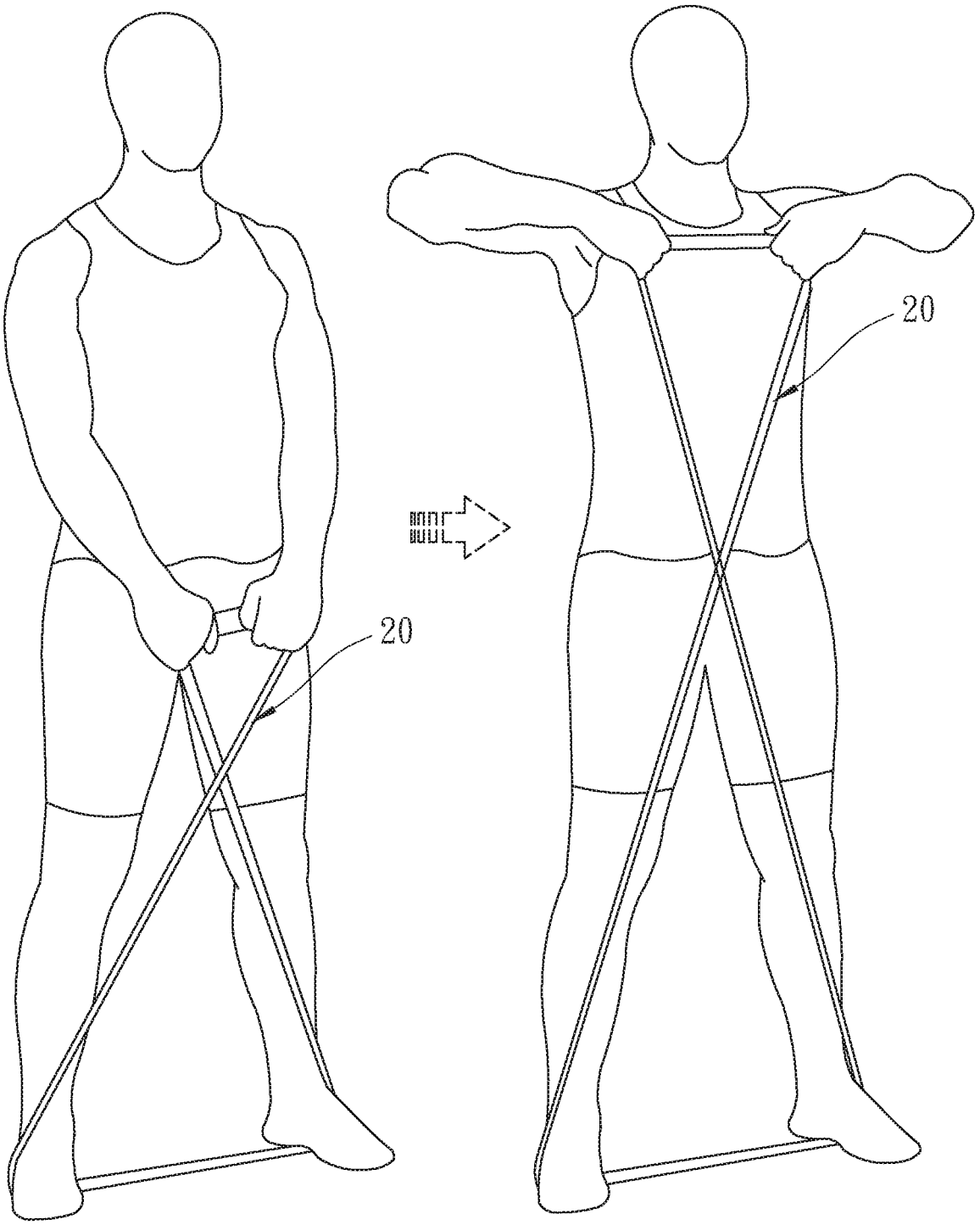
FIGS. 6-10 are a schematic view showing the application of the elastic band according to the preferred embodiment of the present invention.
Figure 7:
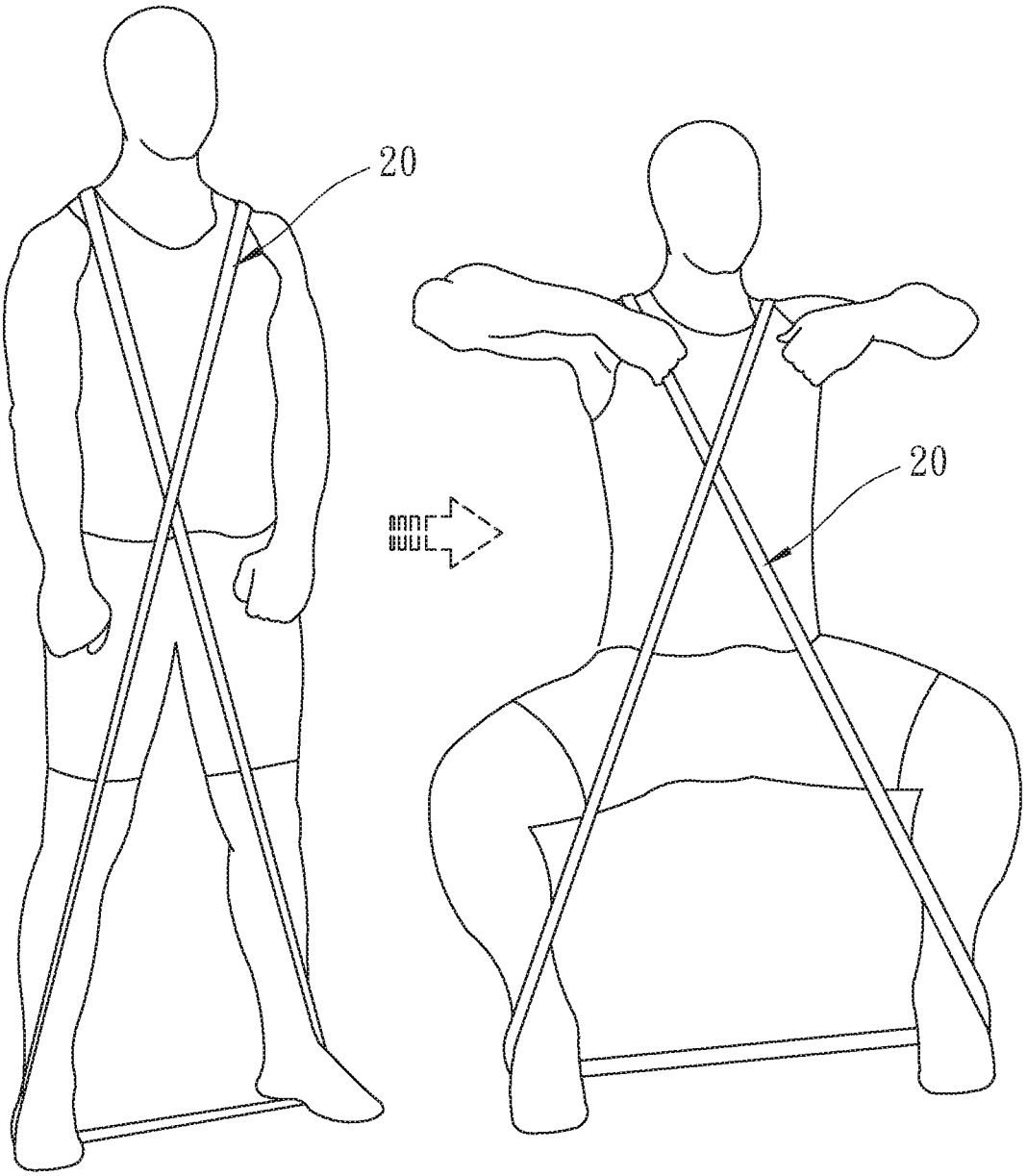
Figure 8:
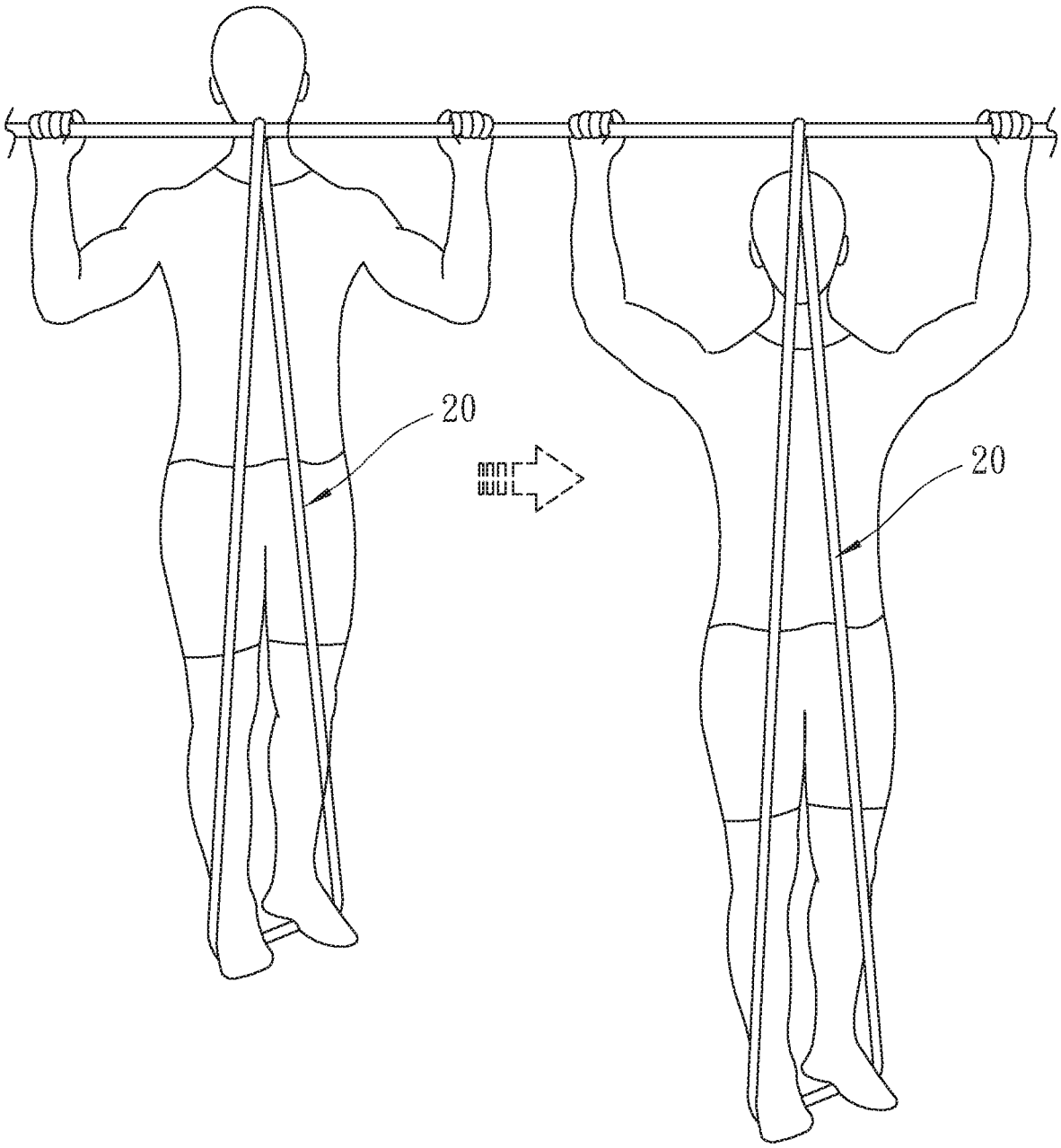
Figure 9:
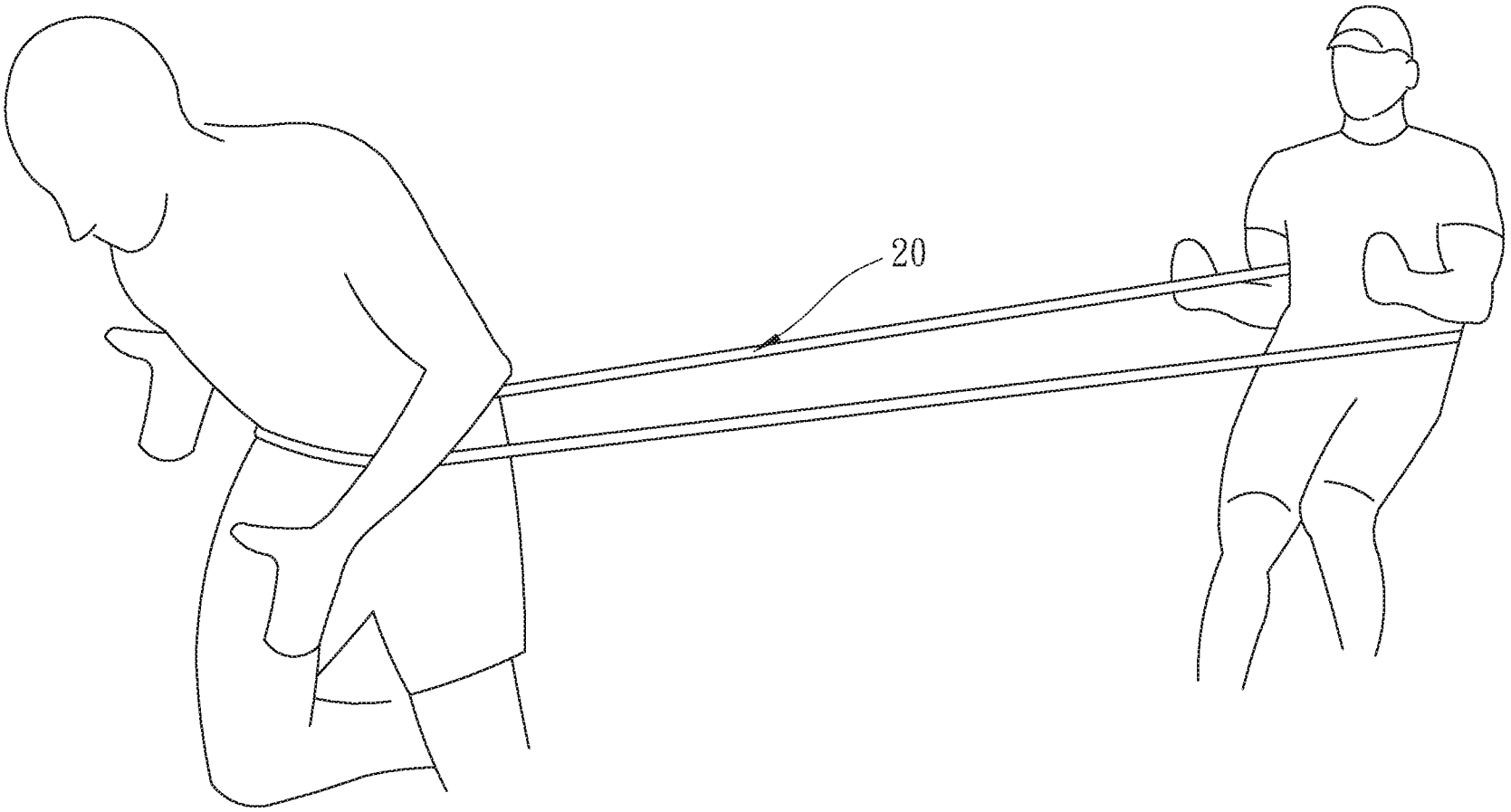
Figure 10:
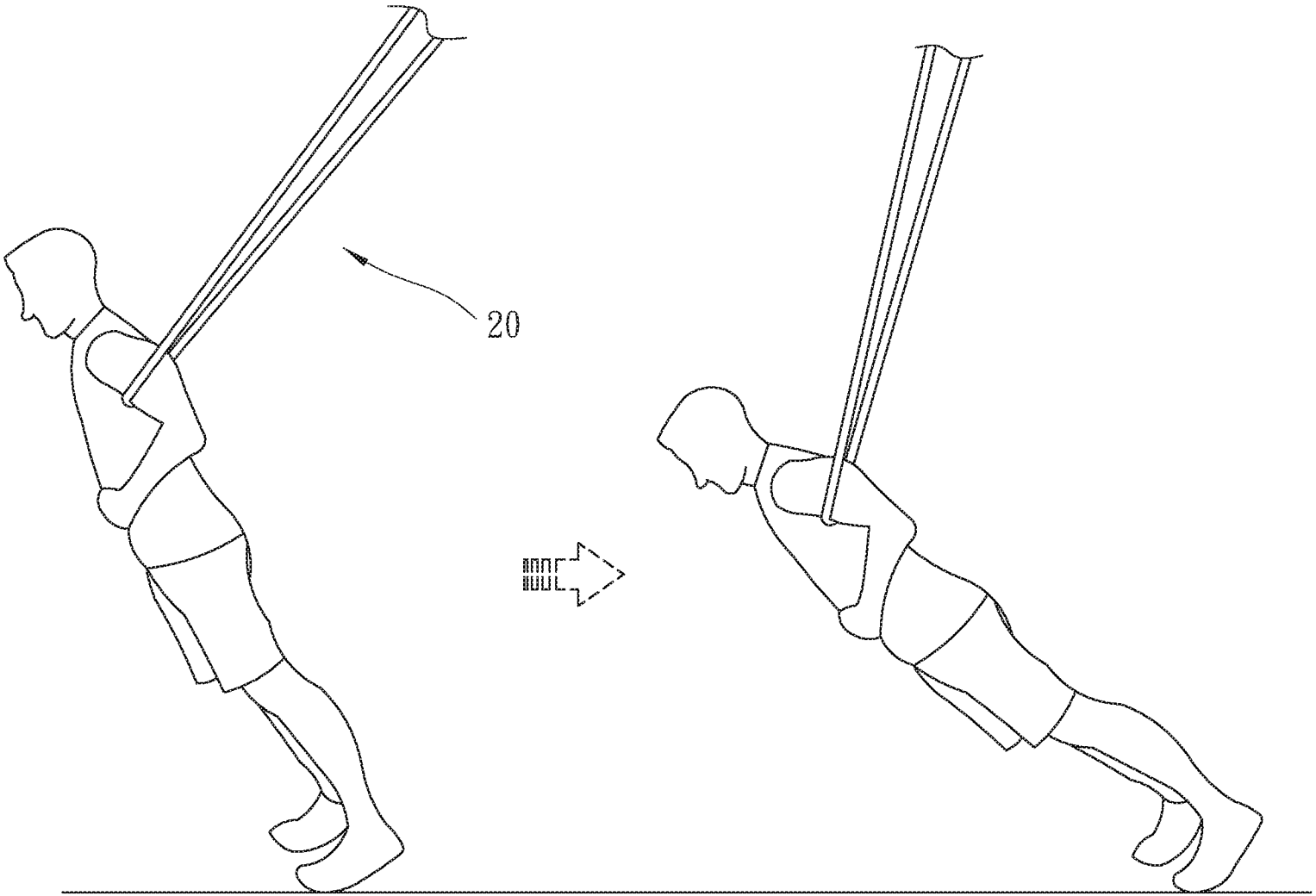

With reference to FIG. 4, the multiple latex yarns 40, the plural latex threads 41, and the plurality of cloth layers 31 are not stretched. Further, as shown in FIG. 4, the elastic band includes a first upper latex yarn (40) and second lower latex yarn (40) and a plurality of latex threads (41) which are disposed between the first latex yarn and second latex yarn, a first warp (30) shown as a loop the figure and second warp (30) depicted as a circle in the figure. The two latex yarns (40) and the three latex threads (41) are parallel to each other and form a plane. The looped warps (30) are either parallel to the plane and the circle warps (30) are perpendicular to the plane. Referring to FIG. 5, the plurality of cloth layers 31 have multiple patterns 311 and plural arcuate portions 312 respectively so that when the multiple patterns 311 are stretched, the plural arcuate portions 312 are pulled straightly with an expansion of the multiple latex yarns 40 and the plural latex threads 41.

Referring to FIGS. 6-10, the elastic band 20 is applied to exercise by a user.

Figure 11:
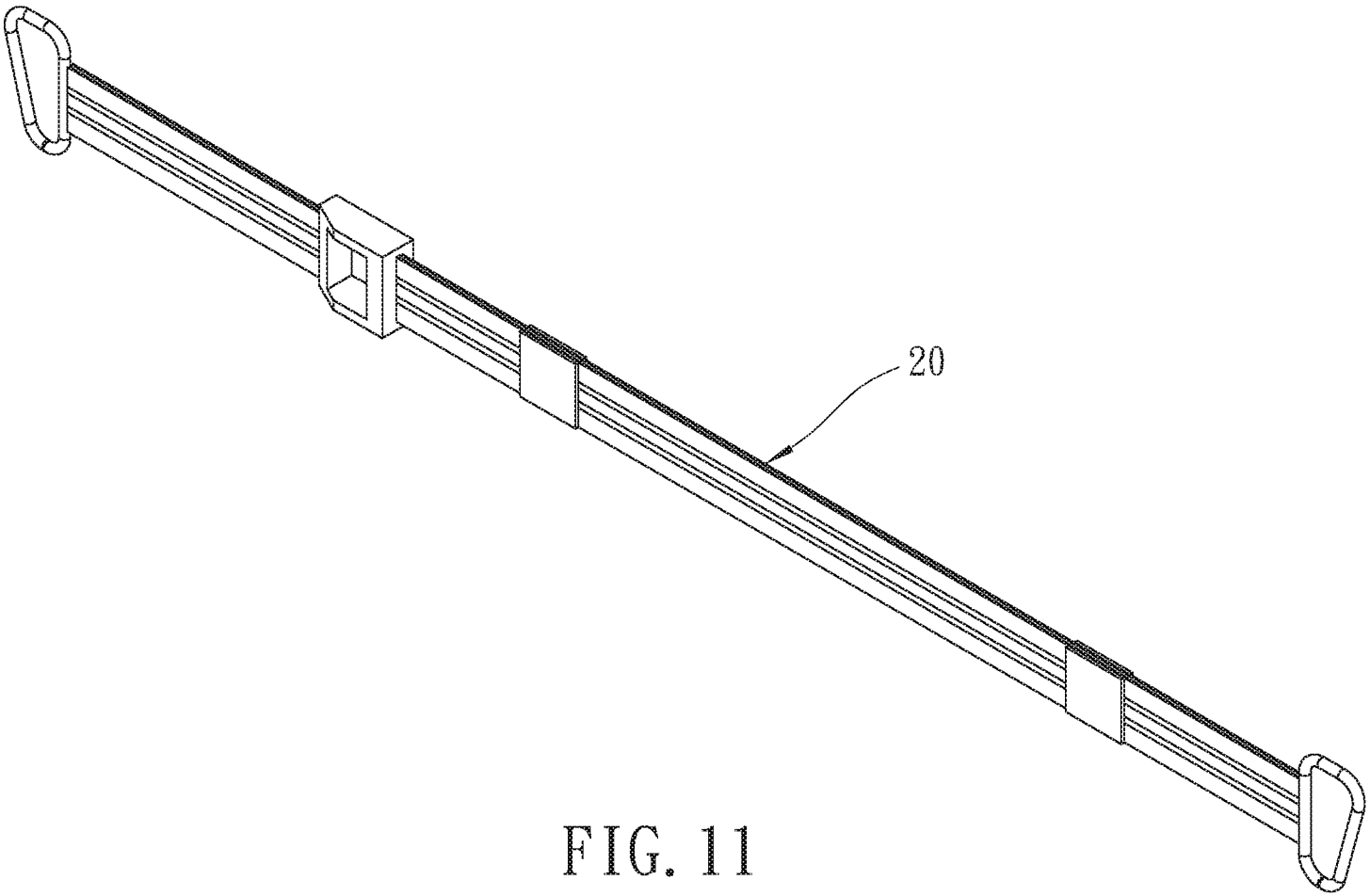
FIGS. 11-13 are another schematic view showing the application of the elastic band according to the preferred embodiment of the present invention.
Figure 12:
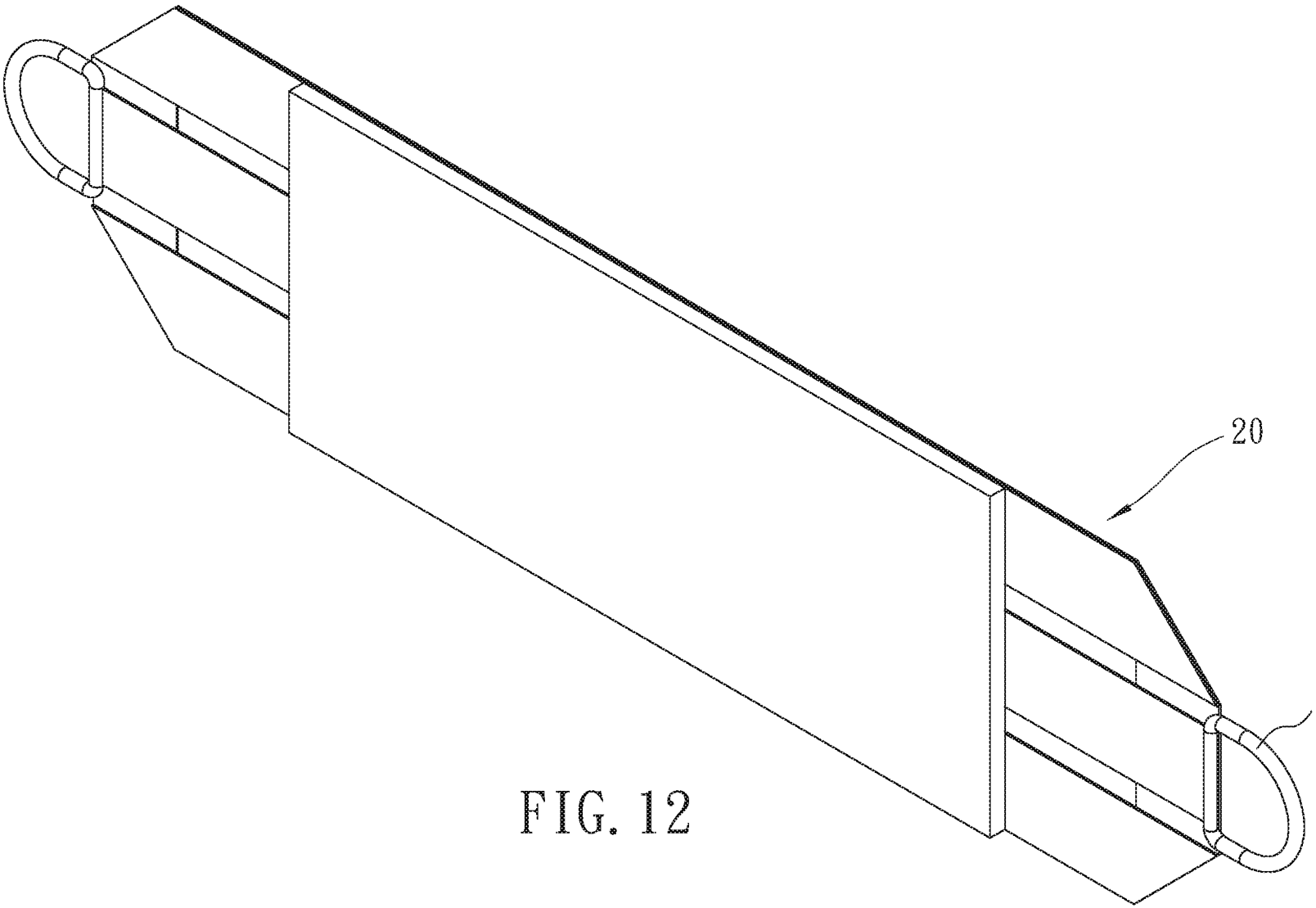
Figure 13:
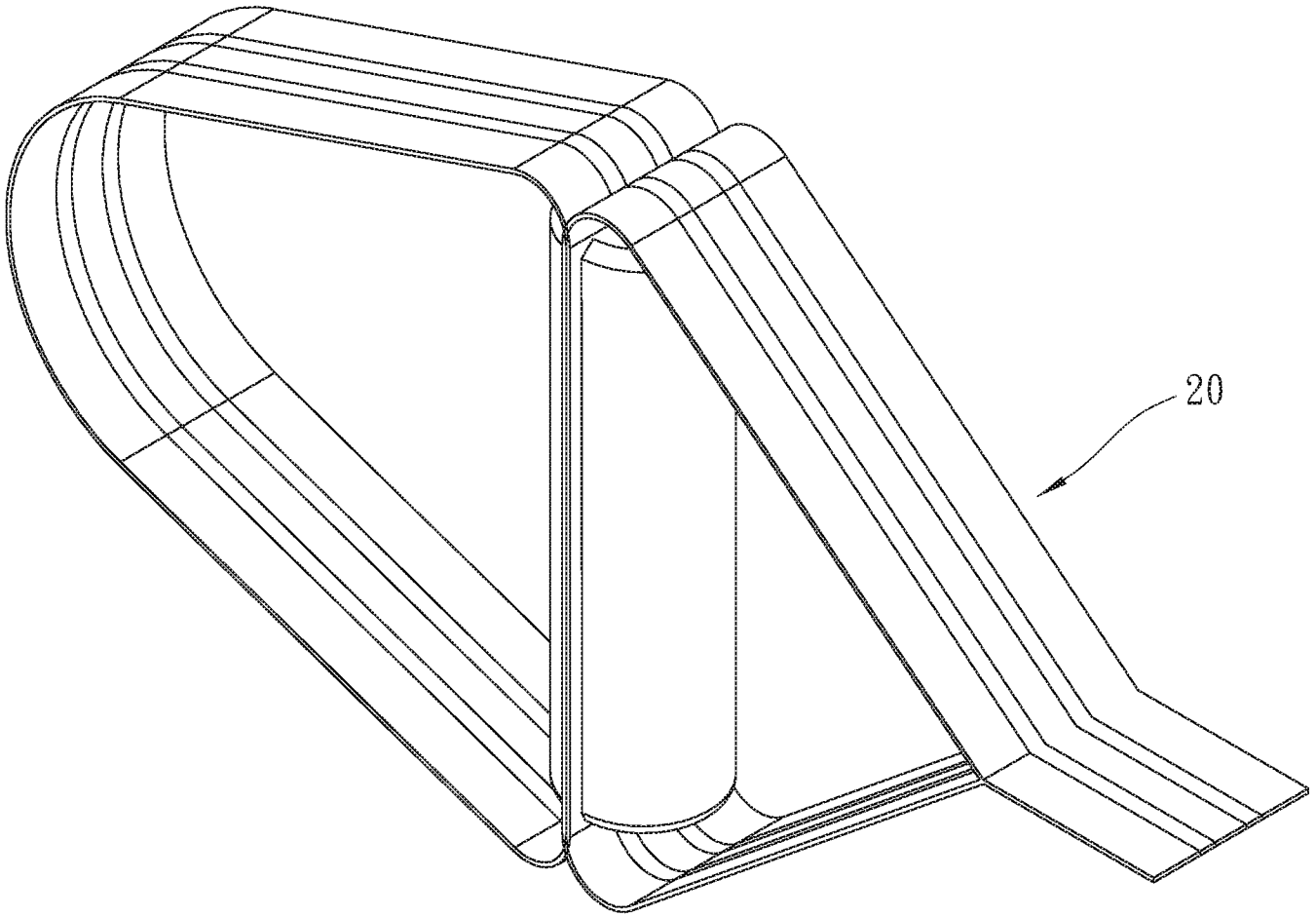

As shown in FIGS. 11-13, the elastic band 20 is applicable for a variety of fitness machines.

While the first embodiments of the invention have been set forth for the purpose of disclosure, modifications of the disclosed embodiments of the invention as well as other embodiments thereof may occur to those skilled in the art. The scope of the claims should not be limited by the first embodiments set forth in the examples, but should be given the broadest interpretation consistent with the description as a whole.

What is claimed is:

1. An elastic band comprising: a first latex yarn and a second latex yarn, wherein the first latex yarn and the second latex yarn are parallel to each other; a plurality of latex threads between the first latex yarn and the second latex yarn; and a plurality of warps, wherein each latex thread of the plurality of latex threads is parallel to each other and to the first latex yarn and the second latex yarn, wherein the first latex yam, the second latex yam and the plurality of latex threads form a plane, wherein the plurality of warps comprises a first warp interweaved with the first latex yarn, the second latex yarn and the plurality of latex threads, and the first warp crosses with the first latex yarn, the second latex yarn and the plurality of latex threads in directions substantially parallel to the plane; and wherein the plurality of warps further comprises a second warp interweaved with the first latex yarn, the second latex yarn or at least one latex thread of the plurality of latex threads, and the second warp crosses with the first latex yarn, the second latex yarn or the at least one latex thread of the plurality of latex threads in directions substantially perpendicular to the plane and wherein the plurality of warps form a plurality of cloth layers covering the first latex yarn, the second latex yarn and the plurality of latex threads.

2. The elastic band as claimed in claim 1, wherein a number of warps in the plurality of warps is 240, and a number of latex threads in the plurality of latex threads is 151.

3. The elastic band as claimed in claim 1, wherein a width of the elastic band is within 1 cm to 11 cm, a thickness of the elastic band is within 0.4 cm to 5 cm, and a length of the elastic band is within 50 cm to 500 cm.

4. An elastic band comprising: a first rubber yarn and a second rubber yarn, wherein the first rubber yarn and the second rubber yarn are parallel to each other; a plurality of rubber threads between the first rubber yarn and the second rubber yarn; and a plurality of warps, wherein each rubber thread of the plurality of rubber threads is parallel to each other and to the first rubber yarn and the second rubber yarn, wherein the first rubber yarn, the second rubber yarn and the plurality of rubber threads form a plane, wherein the plurality of warps comprises a first warp interweaved with the first rubber yarn, the second rubber yarn and the plurality of rubber threads, and the first warp crosses with the first rubber yarn, the second rubber yarn and the plurality of rubber threads in directions substantially parallel to the plane, and wherein the plurality of warps further comprises a second warp interweaved with the first rubber yarn, the second rubber yarn or at least one rubber thread of the plurality of rubber threads, and the second warp crosses with the first rubber yarn, the second rubber yarn or the at least one rubber thread of the plurality of rubber threads in directions substantially perpendicular to the plane; and wherein the plurality of warps further comprises a second warp interweaved with the first latex yarn, the second latex crosses with the first latex yarn, the second latex yarn or the at least one latex thread of the plurality of latex threads in directions substantially perpendicular to the plane and wherein the plurality of warps form a plurality of cloth layers covering the first latex yarn.

5. An elastic band comprising: a first thermoplastic-rubber (TPR) yarn and a second TPR yarn, wherein the first TPR yarn and the second TPR yarn are parallel to each other; a plurality of TPR threads between the first TPR yarn and the second TPR yarn; and a plurality of warps, wherein each TPR thread of the plurality of TPR threads is parallel to each other and to the first TPR yarn and the second TPR yarn, wherein the first TPR yarn, the second TPR yarn and the plurality of TPR threads form a plane, wherein the plurality of warps comprises a first warp interweaved with the first TPR yarn, the second TPR yarn and the plurality of TPR threads, and the first warp crosses with the first TPR yarn, the second TPR yarn and the plurality of TPR threads in directions substantially parallel to the plane, and wherein the plurality of warps further comprises a second warp interweaved with the first TPR yarn, the second TPR yarn or at least one TPR thread of the plurality of TPR threads, and the second warp crosses with the first TPR yarn, the second TPR yarn or the at least one TPR thread of the plurality of TPR threads in directions substantially perpendicular to the plane; and wherein the plurality of warps further comprises a second warp interweaved with the first latex yarn, the second latex yarn or at least one latex thred of the plurality of latex threads, and the second warp crosses with the first latex yarn, the second latex yarn or the at least one latex thread of the plurality of latex threads in directions substantially perpendicular to the plane and wherein the plurality of warps form a plurality of cloth layers covering the first latex yarn, the second latex yarn and the plurality of latex threads.

* * * * *